United States Patent [19]

Strelnieks

[11] Patent Number: 4,719,957

[45] Date of Patent: Jan. 19, 1988

[54] PARTITIONING APPARATUS

[76] Inventor: John Strelnieks, 3850 Wind Drift Dr., Apt. 2C, Indianapolis, Ind. 46254

[21] Appl. No.: 855,320

[22] Filed: Apr. 24, 1986

[51] Int. Cl.[4] ..... A47H 1/00

[52] U.S. Cl. ..... 160/332; 160/196 R; 160/330

[58] Field of Search ..... 160/332, 166 R, 166 A, 160/340, 176 R, 196 R, 196 D, 330

[56] References Cited

U.S. PATENT DOCUMENTS

| | | | |
|---|---|---|---|
| 324,519 | 8/1885 | Bates | 160/332 |
| 1,835,644 | 12/1931 | Grassi | 160/332 X |
| 3,977,458 | 8/1976 | Kuen | 160/332 |

FOREIGN PATENT DOCUMENTS

| | | | |
|---|---|---|---|
| 2054712 | 2/1981 | United Kingdom | 160/332 |

*Primary Examiner*—Ramon S. Britts
*Assistant Examiner*—Blair M. Johnson
*Attorney, Agent, or Firm*—Woodard, Emhardt, Naughton, Moriarty & McNett

[57] ABSTRACT

A screen is made of hanging strands of beads of relatively large size and light weight. The beads are arranged to provide sound and thermal insulation to the extent desired between the spaces in a building on opposite sides of the screen. Two types of strand mountings are disclosed, with mechanism suitable to shift the strands laterally to increase or decrease the amount of occlusion provided between the spaces by the screen.

5 Claims, 11 Drawing Figures

PARTITIONING APPARATUS

BACKGROUND OF THE INVENTION

This invention relates generally to apparatus for partitioning between spaces in a building, but flexible to permit passage through the partition.

Many devices are used for door or window openings in a building for producing a type of screening effect or decorative effect. Examples are United States patents as follows:

| U.S. Pat. No. | Inventor | Filing Date |
|---|---|---|
| 324,519 | Bates | Aug. 18, 1885 |
| 510,590 | Dreyfus | Dec. 12, 1893 |
| 534,828 | Hensel | Feb. 26, 1895 |
| 795,972 | Harding | Aug. 1, 1905 |
| 903,612 | Smith | Nov. 10, 1908 |
| 1,782,339 | Campobasso | Nov. 18, 1930 |
| 2,255,714 | Rodelli | Sept. 9, 1941 |
| 2,884,054 | Bryant | Apr. 28, 1959 |
| 3,977,458 | Kuen | Aug. 31, 1976 |

All of these, except Smith, use some form of chains of beads or the like hanging from an overhead support.

In addition to the foregoing, there is a U.S. Pat. No. 3,226,285 to Iovenko disclosing in FIG. 14, strands of plastic tubing for a curtain or portiere.

Also, there is a U.S. Pat. No. 3,368,304 issued to Ball and which shows a plurality of vertically hanging flexible strips which can be vibrated to serve as an insect repelling screen.

In addition, it is known to use overlapping transparent plastic strips hanging from a support and located to serve as the front wall of refrigerated product display cabinets or cases, as in some grocery stores.

There has remained a need, but heretofore apparently unrecognized, for partitioning apparatus which is not only decorative, but also useful, versatile, and relatively inexpensive. The present invention is addressed to meeting this need.

SUMMARY OF THE INVENTION

Described briefly, according to a typical embodiment of the present invention, there is a screen made of a plurality of strands of beads of relatively large size and bulky, but light in weight. The beads are arranged such as to provide sound and thermal insulation to the extent desired between the spaces in a building on opposite sides of the screen. Parallel rows of strands may be used, with mechanism suitable to shift the strands laterally to increase or decrease the amount of occlusion provided between the spaces by the screen.

BRIEF DESCRIPTION OF THE DRAWINGS

FIG. 12 is a view like FIG. 1 but showing the apparatus adjusted to a screening rather than a completely closed condition.

DESCRIPTION OF THE PREFERRED EMBODIMENT

Figure 1:
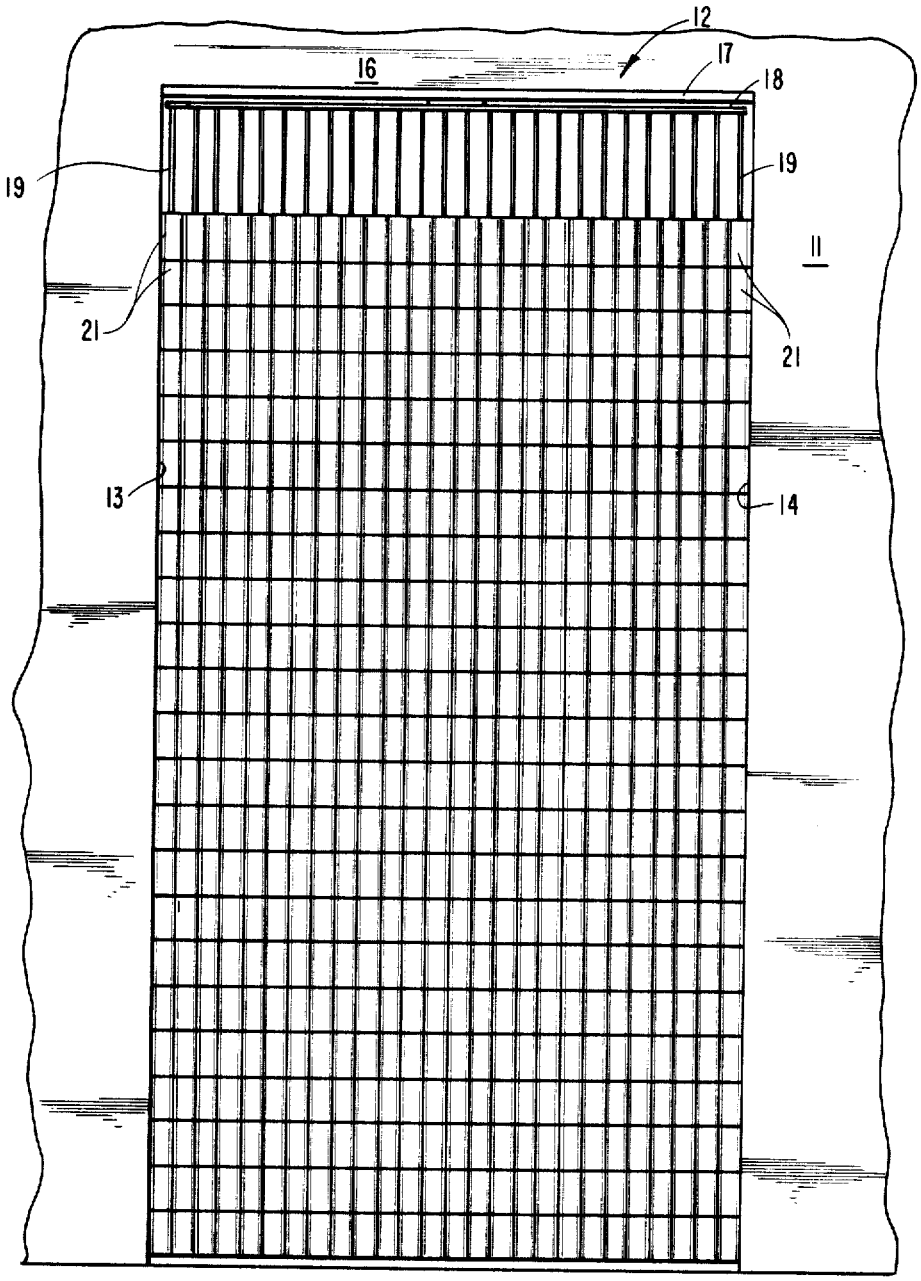
FIG. 1 is a front view of a doorway in a wall, with a typical embodiment of the partitioning apparatus of the present invention serving as a closed door.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
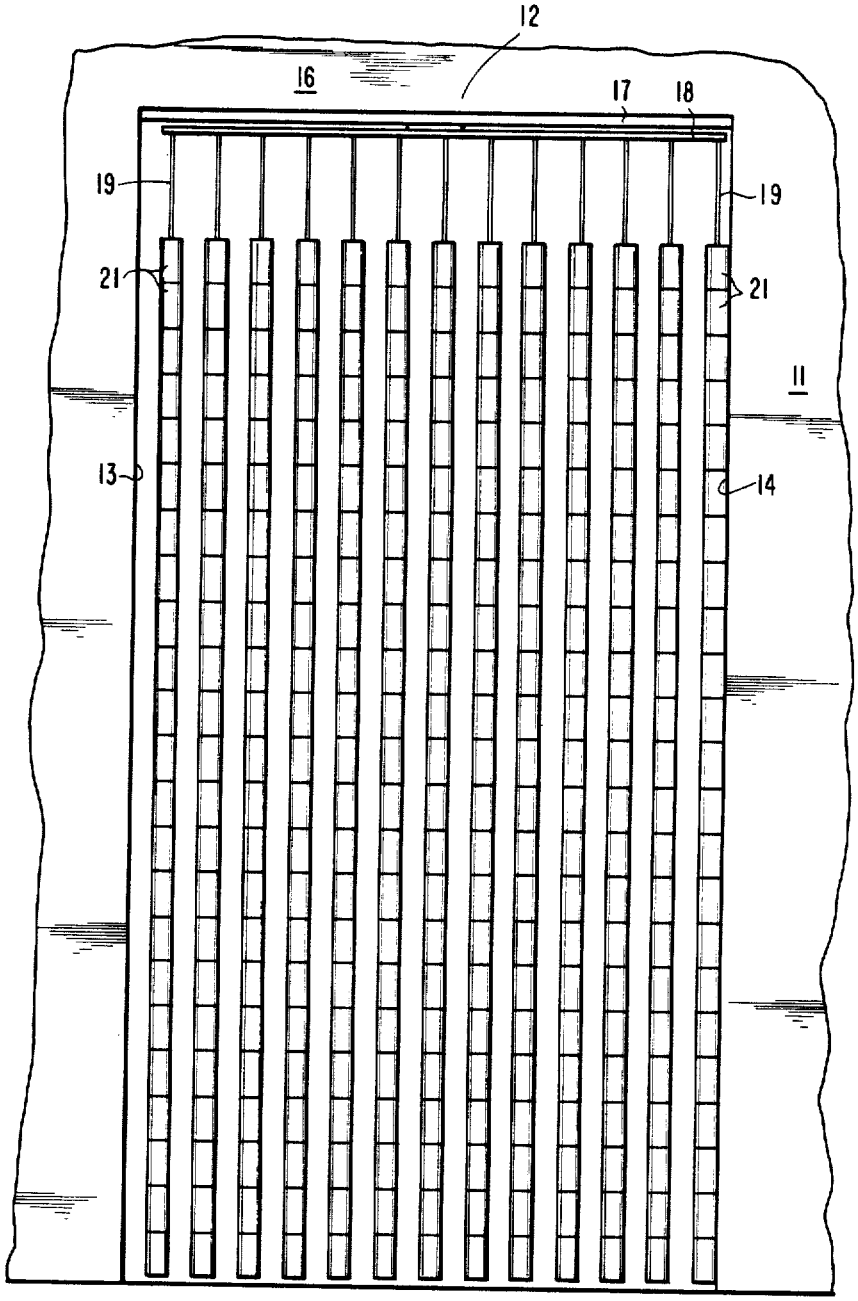

Referring now to the drawings in detail, and particularly FIGS. 1 and 2, a stationary wall 11, in the building has a doorway 12 therein which includes the door jamb at the left and right side 13 and 14 and the header 16. A door header 17 is affixed in the doorway at the bottom of the doorway header 16. A front hanger bar 18 is mounted to the header in a manner to be more fully described hereinafter. Strands 19 hang from the bar 18 and support a plurality of beads 21 which are strung on the strands and supported by a knot at the bottom of the strand and engaging the lowermost one of the beads.

Figure 3:
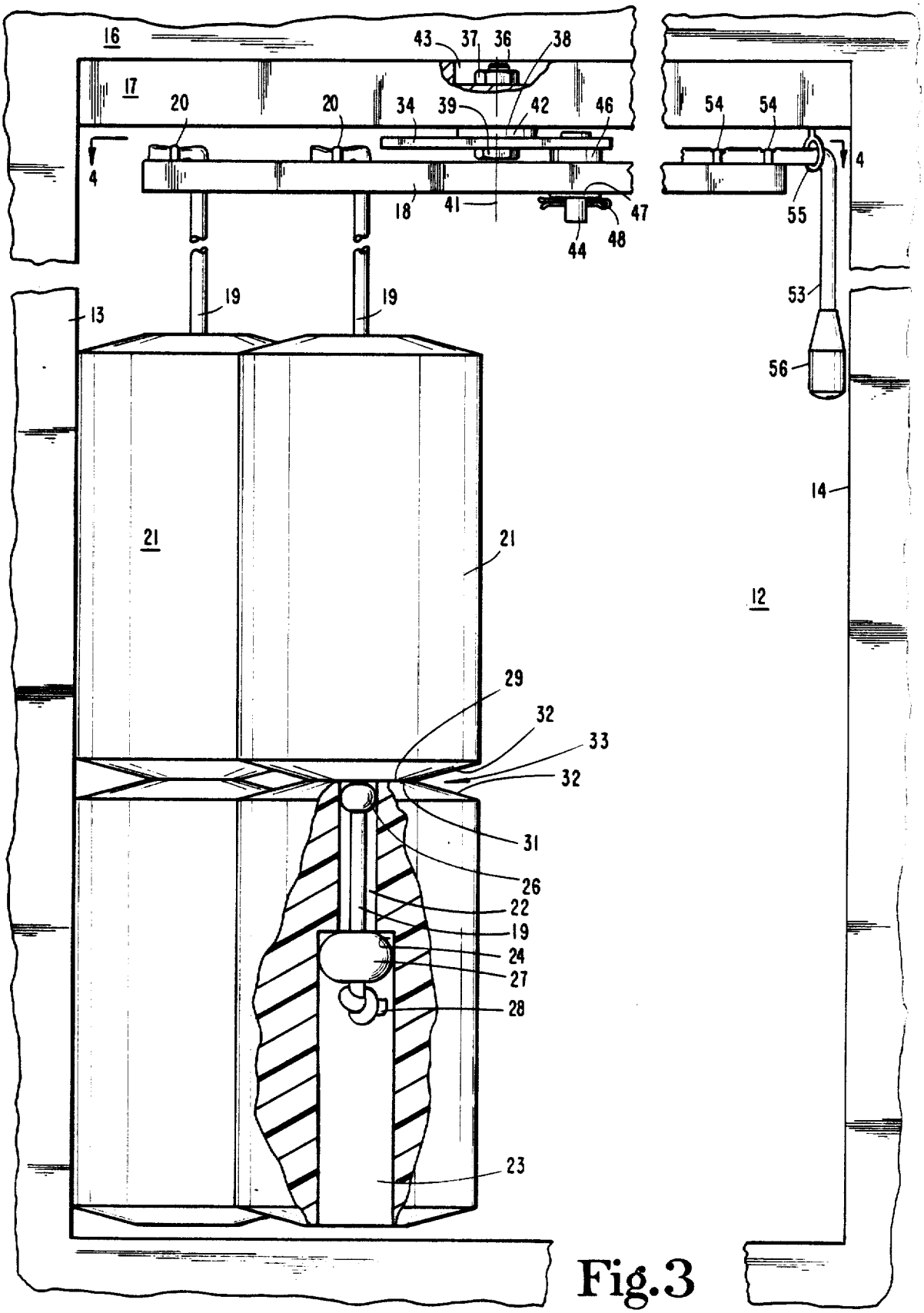
FIG. 3 is a much enlarged fragmentary view of the apparatus of FIG. 1 with portions broken out to conserve space in the drawing, and showing details of the typical embodiment.

Referring now to FIG. 3, the specific nature of the beads 21 can be better seen. They are preferably made of polystyrene foam and are relatively large in size (approximately 2 inch diameter and approximately 4 inch overall length), but very light in weight. Being of this material and in this size, they have significant ability to provide sound and temperature insulation. Each of them is provided with a stepped center bore, the upper portion 22 being of smaller diameter than the lower portion 23. The step 24 is above the center of gravity of the bead. Although these beads do not actually look like beads, they are referred to in this manner for ease of description. Because the material is polystyrene, and therefore very soft and susceptible to wear, a small bead or bushing 26 is provided at the top of the upper bore 22 and slidably receives the strand 19 through it. A large bead or knob 27 is provided under the step 24 and retained by the knot 28 in the strand to thereby support the beads on the strand.

In the illustrated embodiment, each of the beads has a flat at 29, around the aperture at the top and a flat at 31, around the aperture at the bottom. This promotes some stability of the beads in contact with each other and provides some bearing surface which is particularly desirable for the beads near the bottom of the strand as they must support all of the beads above them. But, there is also provided a conical surface 32 immediately outboard of the flat at both the top and bottom of each of the beads. This provides some relief space 33 between the beads to enable them to tilt with respect to each other when pushed aside by a person when passing through the doorway. Accordingly, the frusto-conical surfaces at the opposite ends of the beads, have the combined effect of providing good and adequate bearing area between one bead and the next contiguous bead, and also accommodating whatever tilting of the beads is necessary to enable passage through the door, and then contribute to stabilizing of the beads in columns when the person has passed through the doorway.

Figure 4:
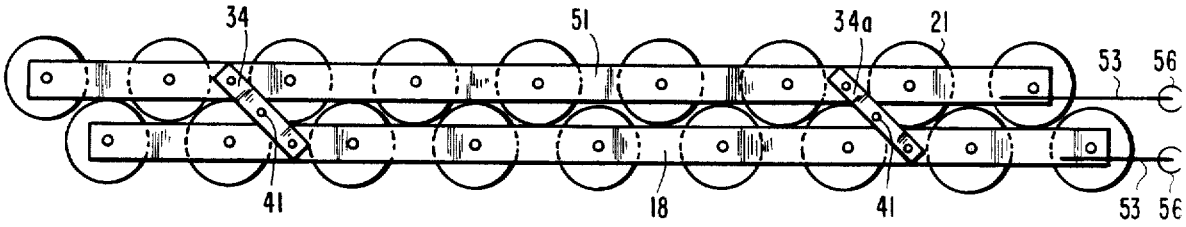
FIG. 4 is a schematic top plan view of the apparatus in the closed position.
Figure 5:
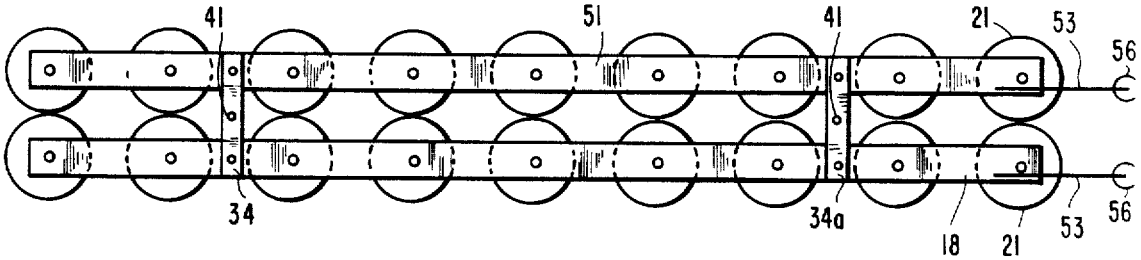
FIG. 5 is a schematic top plan view of the apparatus in the open position.

Referring now to FIGS. 3, 4 and 5, an example of a possible mounting of the bar 18 to the header member 17 is shown. In this example, arm 34 is pivotally mounted to a shoulder bolt 36 secured in the member 17 by a nut 37. Being a shoulder bolt and having a shoulder at 38 abutting the lower face of header bar member 17, the arm 34 can rest on the head 39 of the bolt so that it can pivot freely about the axis 41 of the bolt. A washer such as 42 may be provided between the bar 17 and bolt head 39, if desired to promote stability.

The nut 37 is received in a recess 43 in the top of the bar 17. Exactly the same type of construction and mounting can be provided for the bar 34A near the right-end of the hanger bar 18. The hanger bar is mounted to both of these arms 34 and 34A in the same way. More specifically, a pivot pin 44 received through the arm 34 and through the washer 46, bar 18, and washer 47 is secured by means of a cotter pin 48. This permits the arm to pivot relative to the bar 18. It is done for both of the arms 34 and 34A.

A second and rear hanger bar 51 is mounted behind and parallel to bar 18. It is mounted to the pivot arms 34 and 34A in exactly the same way as described above with reference to hanger bar 18. Likewise, a back row of bead hanging strings or strands are provided on bar 51 just as the front row of strands is hung on bar 18. The columns of beads strung on the back row of the strands is done the same as the columns of beads on the front row of strands as described above.

In order to shift the rows from the closed or occluding position of FIGS. 1, 3 and 4, to the open position of FIG. 5, two pulled cords are used. For the front hanger bar, the cord 53 is stapled to the top of the bar 18 at 54, and passed through a screw eye 55 which is screwed into the header bar 17. Pendants or knobs 56 can be provided at the bottom of each of the two cords 53, one for the front bar and one for the rear bar. Accordingly, the curtain can be opened from the closed position of FIG. 1 to the open position of FIG. 2 by pulling the rear cord 53, and closed again by pulling the front cord 53. It was mentioned just above that the cords are fastened to the bars 18 and 51 by staples. This is also a convenient way to secure the hanger strands 19 as by staple 20 (FIG. 3).

Figure 6:
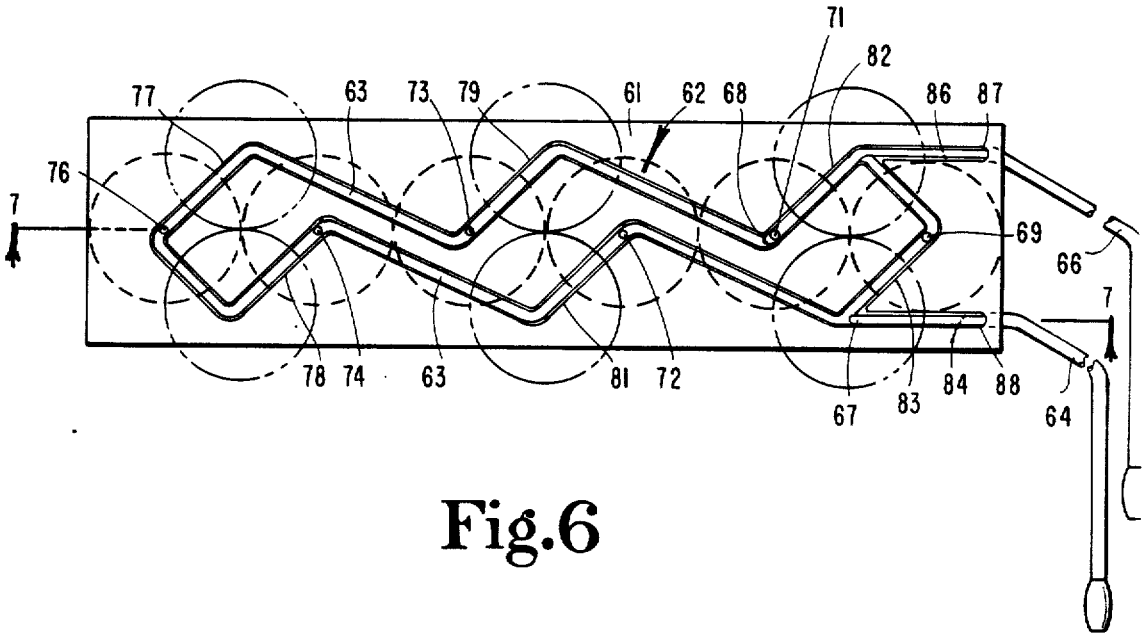
FIG. 6 is a top plan view of an alternate embodiment.
Figure 7:
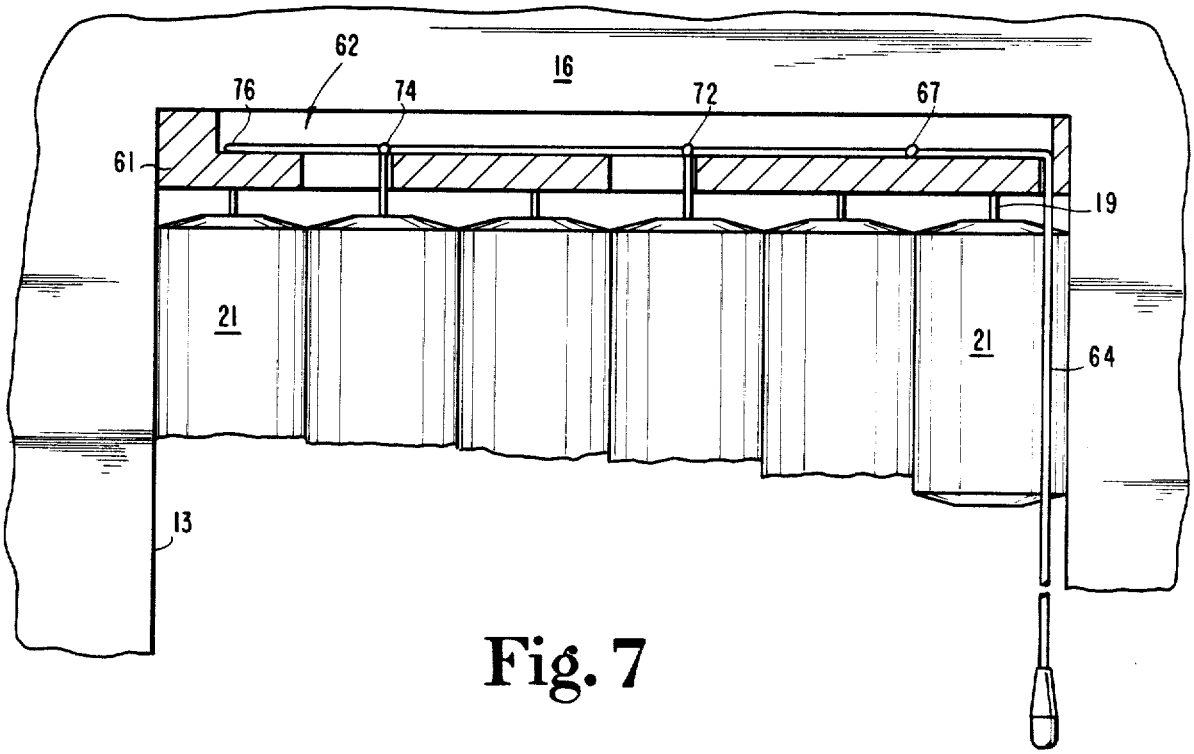
FIG. 7 is a sectional view of the alternate embodiment and taken at lines 7—7 of FIG. 6 and viewed in the direction of the arrows.

FIGS. 6 and 7 shown an alternate construction for opening and closing the screen. In this example, the doorway header 16 and jambs 13 and 14 are shown with the same reference numerals. However, in contrast to the header bar 17 for the embodiment of FIGS. 1-5 a different type of header bar 61 is used. This one has a somewhat serpentine groove 62 in the top face thereof. It has a carrier cord or rope 63 laid in it. The rope can be any suitably strong, flexible, and durable material. Pull cords 64 and 66 are secured to the carrier rope at 67 and 68, respectively. The bead hanger strands are secured to the rope at 69, 71, 72, 73, 74 and 76. A slot through the bottom of the bar is provided at six locations 77, 78, 79, 81, 82 and 83. There are pull cord groove extensions 84 and 86 at the right-hand ends of the serpentine carrier port groove 62. Holes 87 and 88, at the ends of these extension grooves extend through the bottom of the bar 61 and receive the pull cords 66 and 64 through them, respectively.

The beads are shown in the screen closed position in FIG. 7 and in the dotted lines of FIG. 6. The alternate position (not shown in FIG. 7) is shown by the phantom lines in FIG. 6. To achieve that, the cord 66 is pulled downward, pulling the carrier rope in the serpentine groove to move the hanger strands in the through slots from one end of each slot to the other. To again close the screen, the cord 64 is pulled to return the strands to their initial positions.

Figure 8:
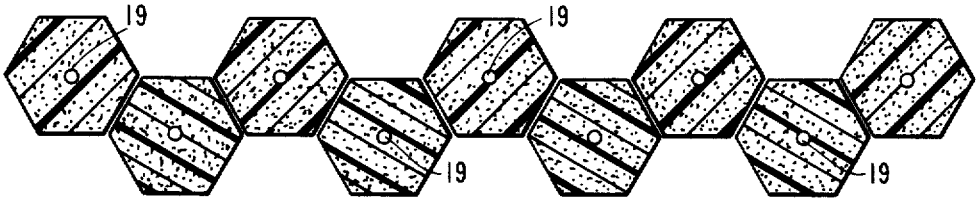
FIG. 8 is a schematic top plan view showing another embodiment.
Figure 9:
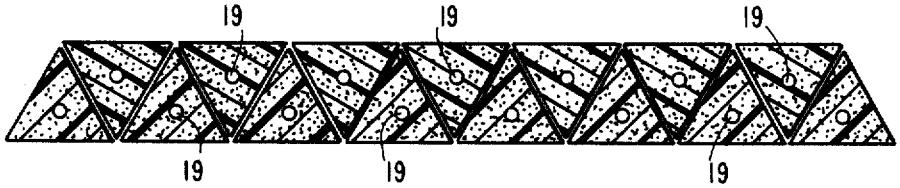
FIG. 9 is a top plan view showing still another embodiment.

FIGS. 8 and 9 show two alternate shapes of beads in two rows. These can be mounted in either the manner shown in FIGS. 1 through 5, or that shown in FIGS. 6 and 7, and operated in the same way. The cross section of the beads in FIG. 8 is hexagonal, while that in FIG. 9 is triangular. In either case, the opening and shutting can be achieved by pull cords in the same way as described above.

Figure 10:
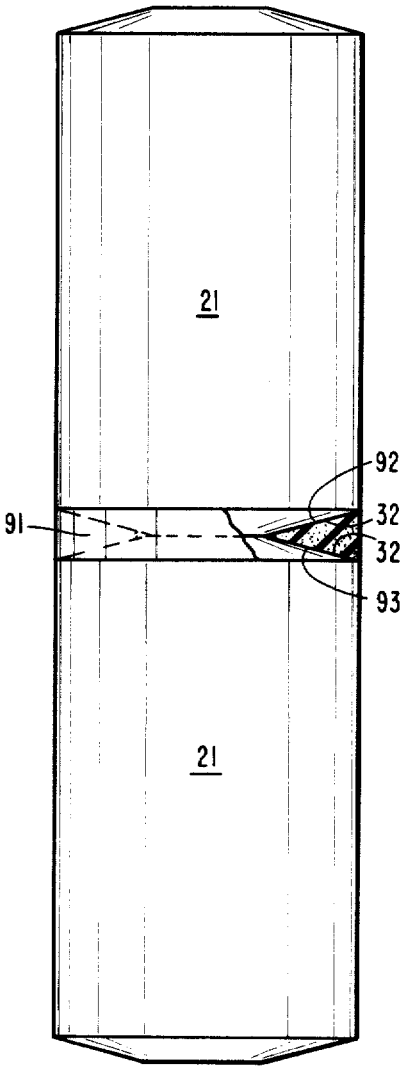
FIG. 10 is a fragmentary view on the same scale as FIG. 3 and showing an additional component.
Figure 11:
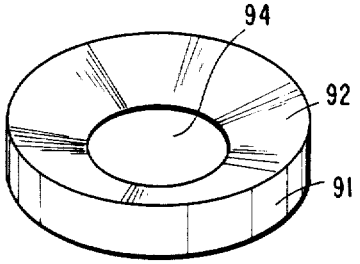
FIG. 11 is a pictorial view of the additional component.

Referring to FIGS. 10 and 11, there is shown an arrangement whereby the clearance space between the upper and lower ends of touching beads can be closed for an additional measure of insulation and/or screening. Foam rubber washers 91 with conical faces 92 and 93 merging at aperture 94 can be provided in the clearance space, the washer being of the type shown in FIG. 11. The use of this arrangement will make the curtain a bit stiffer when a person passes through it, but it will readily return to the original condition, encouraged to do so not only by the gravity influence as with the previously described embodiments, but also the resilience of the washers tending to align the beads between which it is sandwiched.

It should be recognized from the foregoing description, that the bars and arms can be made of wood, metal or plastic. Similarly, the pivoting parts can be made of appropriate materials, metal or plastic being more likely than wood. Also, it may be recognized that variations of the cross sections of the pieces as mentioned above with reference to FIGS. 8 and 9, will provide surface textures of the overall door that are different from the cylinders of FIGS. 1-5. Squares would provide still another apparent surface texture. Also, the beads themselves can have different surface textures, from smooth to flocked, for example. The colors may vary if, and as desired, to achieve different decorative effects. Thus, the present invention provides a very versatile partitioning apparatus which is adjustable from a completely closed appearance to a moderate screening appearance but, in all instances, penetrable by a person walking through the doorway, when desired. At other times, and when in the closed condition, the apparatus provides an excellent sound and thermal insulating function.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Partitioning apparatus comprising:

a first member mountable across an opening in a building;

a first row of bead hanger strands carried by said first member;

a second row of bead hanger strands carried by said first member parallel to said first row of bead hanger strands;

strand shifting means associated with said first member and said strands to proximately shift the strands; and a plurality of beads having apertures receiving said hanger strands through them, said beads hanging on said strands and operable, when the strands are shifted, to move from a full screening position to a partial screening position; and wherein the shifting means include:

first and second parallel hanger bars, the strands being suspended from said hanger bars;

pivot arms mounted to said first member and connected to said hanger bars and pivotable to shift the positions of said hanger bars between a position at which said strands are in the full screening position and a position at which said strands are in the partial screening position.

2. The apparatus of claim 1 and further comprising:

first and second pull cord means attached to said first and second hanger bars, respectively, to facilitate shifting the positions of said hanger bars to shift said strands from the full screening to the partial screening position.

3. Partitioning apparatus comprising:

a first member mountable across an opening in a building;

a first row of bead hanger strands carried by said first member;

a second row of bead hanger strands carried by said first member parallel to said first row of bead hanger strands;

strand moving means associated with said first member and said strands to proximately shift the strands; and a plurality of beads having apertures receiving said hanger strands through them, said beads hanging on said strands and operable, when the strands are shifted, to move from a full screening position to a partial screening position;

wherein said first member has a carrier cord groove therein, and said strand moving means includes;

a carrier cord in said carrier cord groove in the first member, said hanger strands being connected to said cord; and pull cord means mounted to said carrier cord to shift the strands; and wherein said apparatus further comprises;

slots at spaced locations in the bottom of the carrier cord groove and extending through the first member to the bottom thereof and receiving said hanger strands therethrough and accommodating the shifting of the strands from the full screening to the partial screening position.

4. Partitioning apparatus comprising:

a first member mountable across an opening in a building;

a first row of bead hanger strands carried by said first member;

a second flow of bead hanger strands carried by said first member parallel to said first row of bead hanger strands;

strand moving means associated with said first member and said strands to proximately shift the strands; and a plurality of beads having apertures receiving said hanger strands through them, said beads hanging on said strands and operable, when the strands are shifted, to move from a full screening position to a partial screening position;

the beads having flat end portions, and the flat end portions of abutting beads in a column engaging each other at areas around said central apertures in the beads;

the bead ends having conical surfaces outboard of the flat end portions, the abutting ends thereby having portions which diverge from each other to provide clearance space to facilitate tilting of the beads with respect to each other upon application of external lateral pressure to them; and washer members in the clearance space between the diverging portions of the bead ends to fill the clearance space, said washer members being flexible and resilient to accommodate relative tilting of the beads but resiliently urging of the beads to alignment thereof in columns.

5. Partitioning apparatus comprising:

support means for hanging a plurality of strands across an opening in a building;

a first row of bead hanger strands carried by said support means;

a plurality of beads hanging on said strands, said beads being adapted for light, sound and temperature insulation and made of foam plastic;

the beads having central apertures therein, said apertures having diameters greater than the diameters of the strands, and the beads having flat end portions around the central apertures, and sloping end surfaces outboard of the flat end portions; and wear beads in the apertures and located at the tops of the first-mentioned beads, the wear beads being snugly secured in the apertures, the strands being slidably received in the wear beads.

* * * * *

UNITED STATES PATENT AND TRADEMARK OFFICE

CERTIFICATE OF CORRECTION

PATENT NO. : 4,719,957

DATED : January 19, 1988

INVENTOR(S) : John Strelnieks

It is certified that error appears in the above-identified patent and that said Letters Patent is hereby corrected as shown below:

Column 6, line 10, change "flow" to --row--.

Signed and Sealed this

Twenty-first Day of June, 1988

*Attest:*

*Attesting Officer*

DONALD J. QUIGG

*Commissioner of Patents and Trademarks*